United States Patent [19]

Milyard

[11] Patent Number: 4,830,069

[45] Date of Patent: May 16, 1989

[54] WOODWORKING MACHINE

[76] Inventor: Emmert Milyard, 17 Jefferson St., Brookville, Ohio 45309

[21] Appl. No.: 193,830

[22] Filed: May 16, 1988

[51] Int. Cl.[4] ..... B27C 9/00

[52] U.S. Cl. ..... 144/1 C; 144/1 B; 144/35 A; 144/48

[58] Field of Search ..... 144/1 R, 1 B, 1 C, 35 R, 144/35 A, 48, 1 H, 46, 74

[56] References Cited

U.S. PATENT DOCUMENTS

| | | | |
|---|---|---|---|
| 1,621,199 | 3/1927 | Pierce | 144/1 B |
| 2,071,201 | 2/1937 | Frech | 144/1 B |
| 2,109,061 | 2/1938 | Dietrich | 144/1 B |
| 2,619,135 | 11/1952 | Callaway | 144/1 B |
| 3,484,917 | 12/1964 | Roods et al. | 144/48 X |
| 3,671,889 | 1/1963 | Silver | 144/35 A X |

*Primary Examiner*—W. Donald Bray
*Attorney, Agent, or Firm*—Jerome P. Bloom

[57] ABSTRACT

A multiple use woodworking machine having a multiplicity of working stations in which different operations can be performed simultaneously, if so desired. This machine is characterized by simplicity, convenience and versatility, providing within the bounds thereof an essentially complete home workshop. A feature of the machine is a main shaft which constitutes its principal moving part. Rotation of this simply constructed shaft is utilized in carrying out a multiplicity of operations including, for example, sawing, surface sanding, drilling, disc sanding and lathe operations. A preferred illustrative embodiment of the disclosed invention, as described, mounts a drum sander to an intermediate portion of the length of the shaft which at the same time mounts to one end thereof a variably positioned saw and connected adjacent its opposite end a drill press which is rotatably adjustable with reference thereto and at its opposite end a selection of adapters providing a variety of tools all of which mount in driven relation to the shaft. Further associated with said opposite end of said shaft is a variably adjustable tool and work rest assembly, which is simply and effectively disposed to provide a highly functional unique aid in working and finishing a variety of products within the limits of the multiple use woodworking machine of which they form a part.

25 Claims, 8 Drawing Sheets

FIG-12
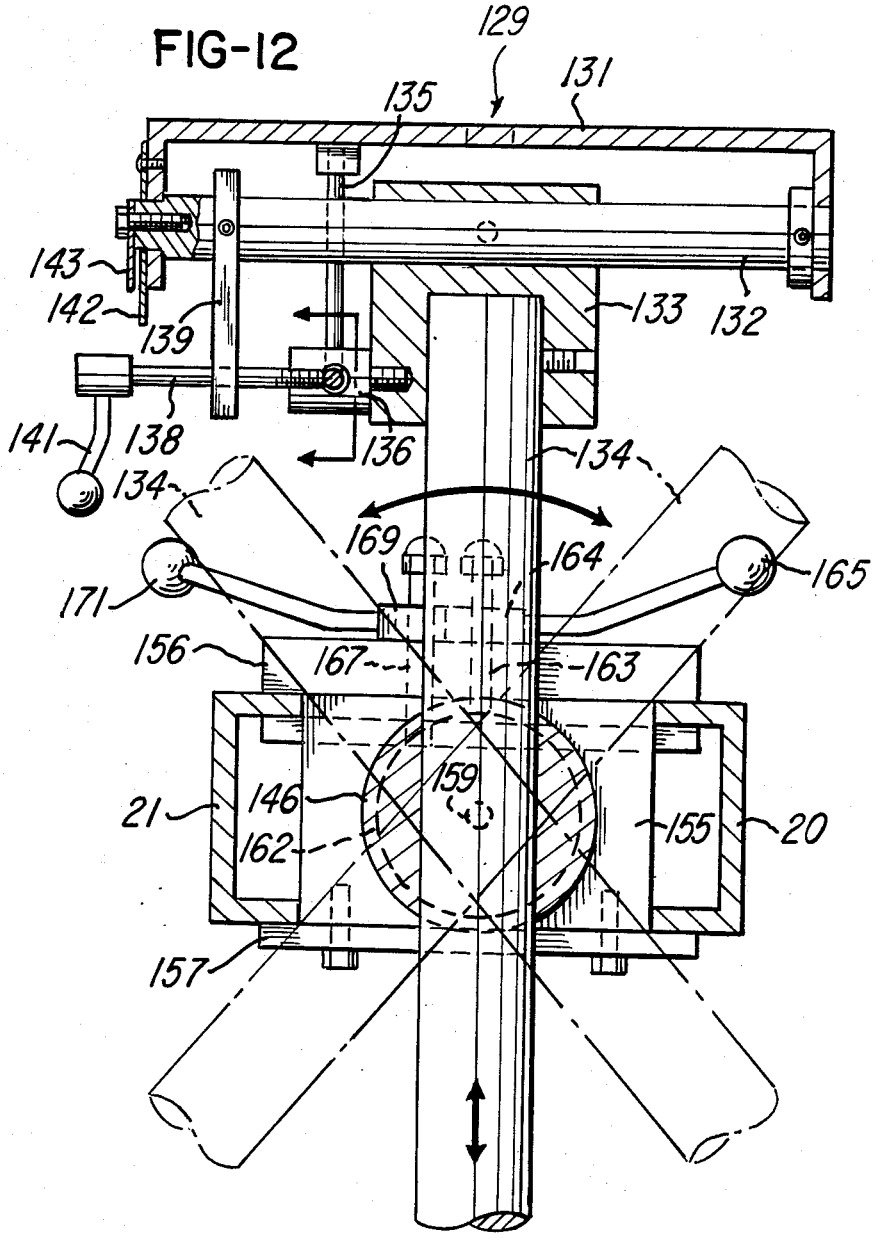
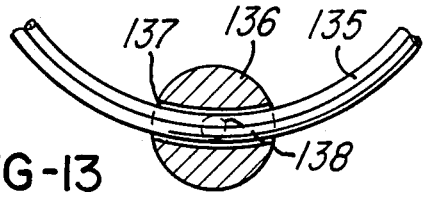
FIG-13

202
198
182
199
205
206
203
201
204
200
17
197
196
184
191
300
188
183
195
185
186
189
193
194
191
187
17

197
191
197
188
186
191
198
196
202
203
207
208
212
200
209
197

300
211
195
187
194
186
188

WOODWORKING MACHINE

BACKGROUND OF THE INVENTION

This invention relates to multiple use woodworking machines, and has particular though not limited reference to machines of this kind such as found in home workshops. In such applications it is desirable that the machine be simply and reliably constructed, that it be convenient and easy to use, and that it has several functions. In the prior art these objectives are achieved to limited and inconsistent extent. There has been, in particular, no practical realization of the objective of providing a machine in which set-up or changeover time in adapting the machine to a changed use is absolutely minimized.

A search of the prior art for related subject matter uncovered a number of issued U.S. patents. They are:

Meckoski, et al, U.S. Pat. No. 2,501,134, Mar. 21, 1950

Eschenburg, U.S. Pat. No. 2,894,546, July 14, 1959

Warren, U.S. Pat. No. 2,913,021, Nov. 17, 1959

Howey, U.S. Pat. No. 3,299,918, Jan. 24, 1967

Roehrig, U.S. Pat. No. 3,379,230, Apr. 23, 1968

Runkle, et al, U.S. Pat. No. 3,404,714, Oct. 8, 1968

Paquin, U.S. Pat. No. 3,410,326, Nov. 12, 1968

Citation of these references does not constitute an admission that their disclosures are relevant or material to the presently claimed invention. They are cited only as the closest art of which the inventor is now aware.

Meckoski lacks versatility in that it is concerned only with sawing and drilling. Moreover, a major adjustment is required to change from one use to another.

Eschenburg similarly has limited versatility and requires that adjustments be made for selected functions.

Warren makes use of attachments to accomplish his desired ends. Note for example that to change from a lathe function (FIG. 5) to a sanding function (FIG. 8) requires installation of an attachment unit 100. Further, there is no means to adjust the belt sander to vary work effects.

In Howey, major adjustments are required for function changes, as for example a repositioning of the tool frame from a vertical to a horizontal position. Howey does not provide for drum or surface sanding.

Roehrig is concerned only with the surface treatment of workpieces.

Runkle et al shows merely that a radial arm saw may be equipped with a planer attachment.

Paquin has limited versatility and discloses how attachments for drilling and for sawing may be removably mounted to a lathe structure.

SUMMARY OF THE INVENTION

The instant invention provides a woodworking machine offering simplicity, convenience and versatility in such manner as to make it a highly advantageous essentially complete home workshop. It will be understood that the expression "woodworking" as used herein is a term of convenience. The machine will operate not only on wood but on any material which can be drilled, sanded, sawed or otherwise worked, including synthetic and composite materials.

The invention embodiments illustrated include a rotary saw blade, a sanding drum, a rotary working tool such as a sanding disc, lathe elements, and a drill press thereby to constitute what may be considered a substantially complete home work shop. In a preferred invention embodiment a motor driven main shaft drives the drill press and is at the same time in driving relation to the saw, the sanding drum and a variety of other working tools in connection with said shaft.

The shaft has a common relationship to all machine functions and is the principal moving part of the machine. It is supported for vertical movement to achieve multiple ends in that the depth of cut of the rotary saw, the amount of surface material removed by the sanding drum, the height of a lathe headstock or the drill press or any other tool may be readily adjusted with reference to the machine bed, as and to the extent required. In the disclosed machine embodiments, the drum sander mounts to the common shaft intermediate its ends, with one projecting shaft end mounting the rotary saw and the other projecting shaft end selectively mounting another working tool and/or a part of the lathe headstock. The drill press is preferably associated with said drive shaft at a location adjacent that end thereof remote from said rotary saw. In a most preferred embodiment of the invention said shaft is in a direct driving relation to the drill press.

The drive shaft is horizontally disposed in the machine in such manner as to place the several working tools associated therewith in a side by side relation, each in a constant readiness for use. A machine operator can select a machine function and have it instantly available. Plural machine operations can be carried out simultaneously, by one or more persons, if desired.

The drill press can assume different radial positions relative to the main drive shaft. A work and tool rest table is supported in the machine between that end of said main drive shaft remote from the end thereof mounting the rotary saw and the lathe tailstock. This tool rest is substantially universally adjustable. The machine includes conveniently located and easily operated controls which provide for motor speed change, for raising and lowering the main shaft, for changing the angle at which a workpiece is held to the rotary saw, and for adjusting the work and tool rest table.

An object of the invention is to provide a woodworking machine, having particular though not limited utility for home workshop use, achieving new levels of simplicity, convenience and versatility.

Another object of the invention is to provide a multiple use woodworking machine which is an essentially complete home workshop the functions of the various elements of which are substantially instantly available for use.

Still another object of the invention is to provide a multiple use woodworking machine in which an operator may switch from one use to another without intervening set-up or changeover procedures and in which operating components are all conveniently accessible.

A further object of the invention is to provide a woodworking machine characterized by a single main moving part in the form of a rotary shaft, the axis of which in the machine may be shifted to introduce variables in machine operations.

A still further object of the invention is to provide in a home workshop or like woodworking machine a drum sander in association with other operating components, for example a rotary saw and a lathe.

A still further object of the invention is to provide a woodworking machine including a main shaft which is the principal working part of the machine and which mounts a drum sander intermediate its ends and which at its opposite ends engageably drives other working tools, including a drill press.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawing wherein is shown one but obviously not necessarily the only form of embodiment of the invention, FIG. 1 is a view in perspective of a woodworking machine in accordance with one embodiment of the invention, the view being in part exploded so that the associated drill press and a sanding disc and spur center may be better seen as to their detail and the manner of their application;

FIG. 12 is a view in cross section, taken substantially along the line 12—12 of FIG. 11;

FIG. 13 is a detail view in section, taken substantially along the line 13—13 of FIG. 12;

Like parts are designated with like numbers throughout the several views evidenced in the foregoing drawings.

Figure 1:
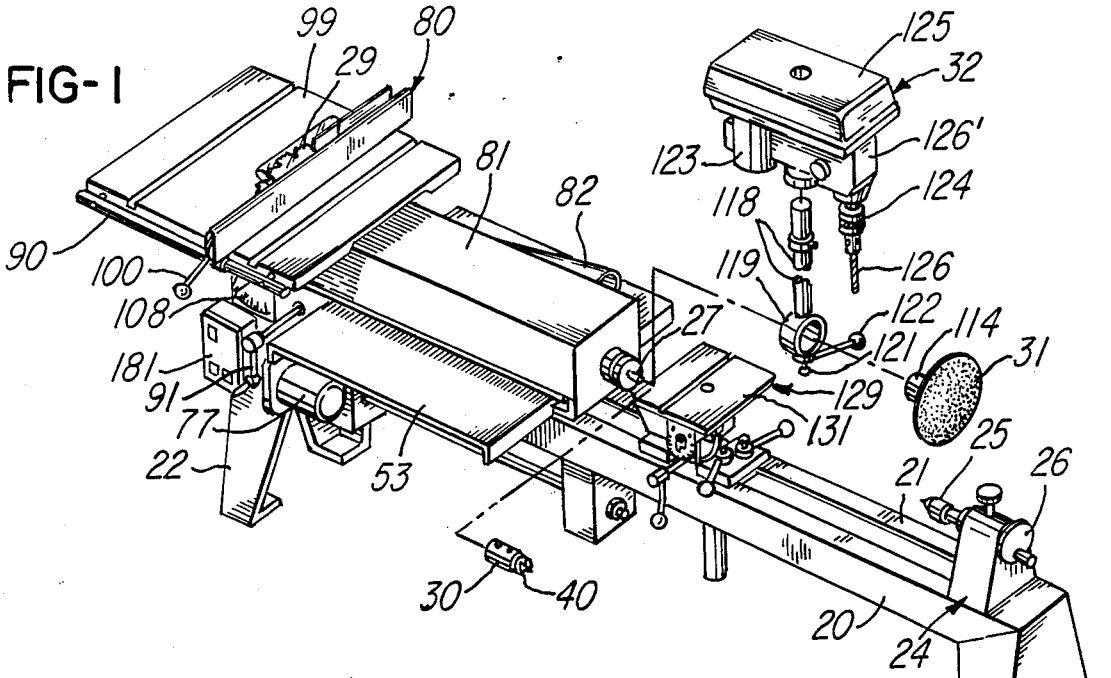

Referring to the drawings, which illustrate preferred but obviously not the only possible embodiments of the invention, machine parts are supported on a frame fabricated of relatively heavy sheet metal so as to be sturdy and stable in use. The frame is in part made up of a pair of elongate laterally spaced apart rails 20 and 21 which at their ends merge with and are supported by legs 22 and 23. Either directly or indirectly the rails 20 and 21 support machine components while the legs 22 and 23 rest on a floor or other supporting surface and place machine components in a relatively elevated position easily accessible to the hands of a user or operator.

At one end of the frame is mounted a lathe tail stock assembly 24 which includes a work engaging nose member 25 advanced and retracted in a conventional manner by a hand crank 26. The nose member of the tail stock assembly orients in an opposed relatively widely spaced relation to a shaft 27. The latter forms part of a head stock assembly, and, as will be understood, forms with the nose member 25 elements of a lathe for a wood turning or like operation.

Shaft 27 is a main operating shaft of the machine responsible not only for powering the lathe but for the operation of other machine operating components including a drum sander 28 (FIG. 3), a rotary saw 29, a sanding disc 31, and, as will be seen in connection with another disclosed embodiment of the invention, of a drill press 182.

Figure 2:
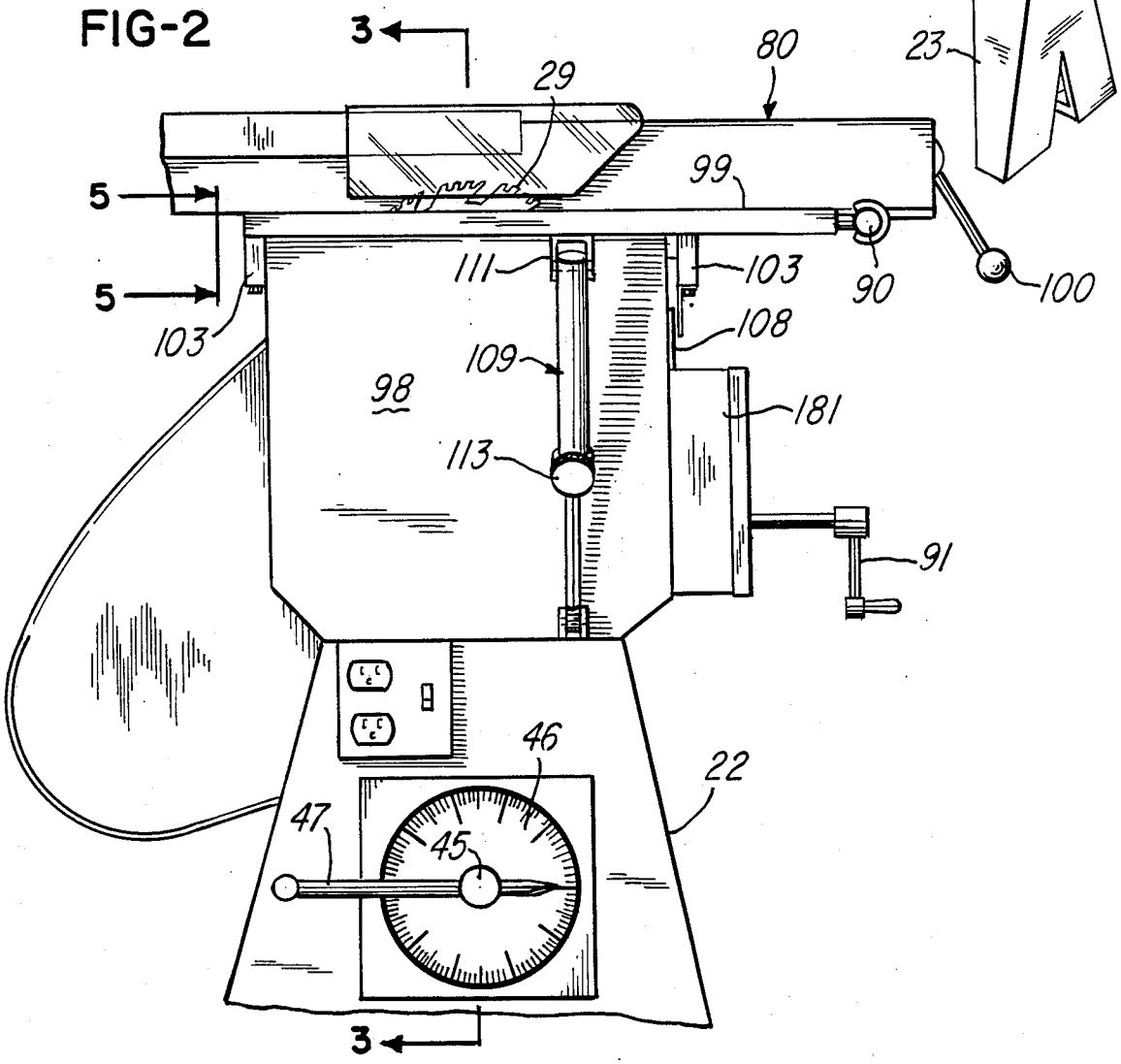
FIG. 2 is a view in end elevation of the machine of FIG. 1.
Figure 3:
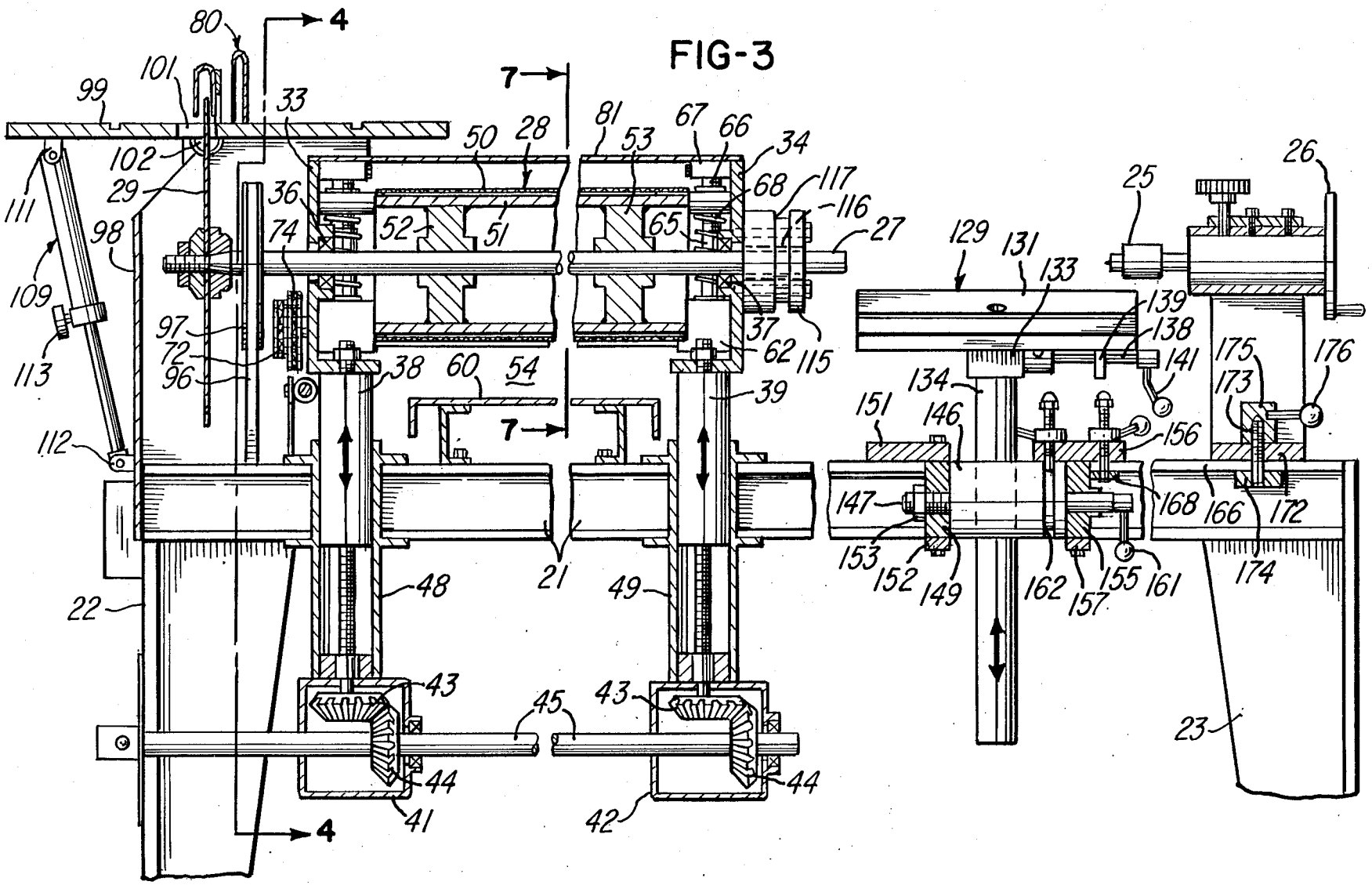
FIG. 3 is a view in longitudinal section taken substantially along the line 3—3 of FIG. 2, some parts being omitted for clarity.
Figure 5:
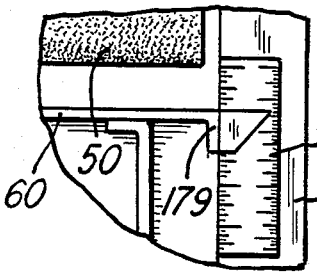
FIG. 5 is a detail view of scale means for indicating the height adjustment of the main shaft, and in particular of the drum sander thereon.
Figure 7:
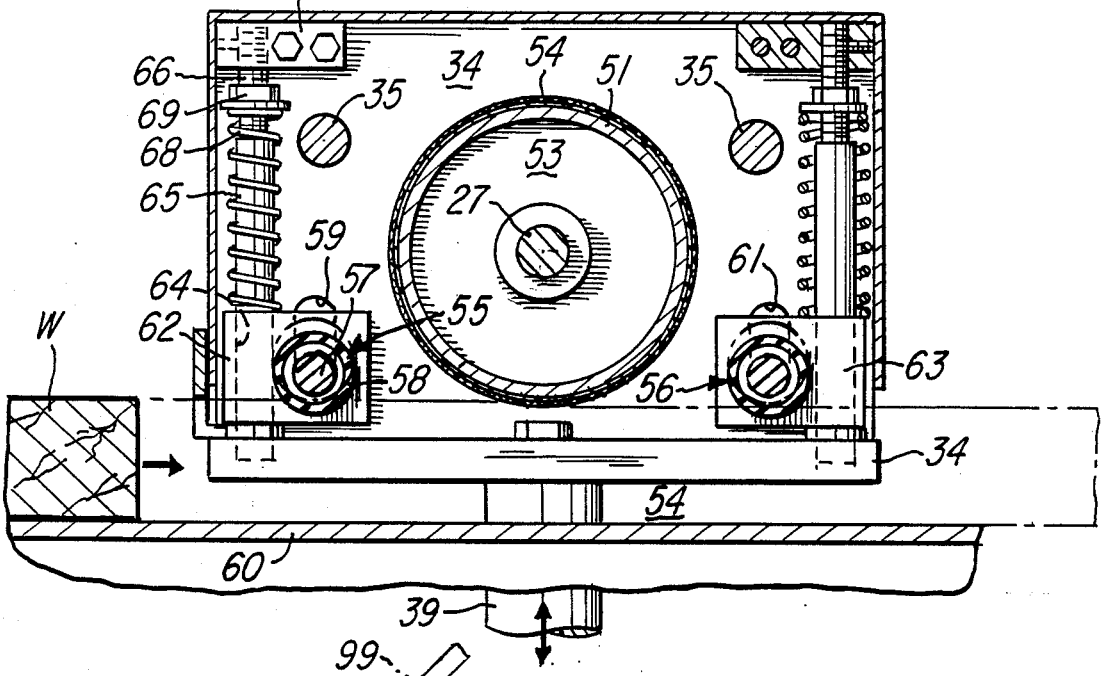
FIG. 7 is a view in cross section taken substantially along the line 7—7 of FIG. 3.

As seen particularly in FIG. 3, a pair of longitudinally spaced apart end plates 33 and 34 provide support for the shaft 27. The plates 33 and 34 are held in a rigidly connected relation by means including rods 35 (FIG. 7). Opposite ends of the shaft project through and beyond respective plates 33 and 34 which provide heavy bearings 36 and 37 in which the shaft is supported for relative rotation. Lower extremities of the plates 33 and 34 are formed as inturned flanges and are bolted to upper ends of respective jack screws 38 and 39. Lower ends of the jack screws extend into respective gear housings 41 and 42, each containing mating spur gears 43 and 44. Gears 43 are connected to the lower end of respective jack screws while gears 44 have a spaced apart relation on a rod 45 which is in a transverse underlying relation to the jack screws and in an intersecting relation to the gear housings 41 and 42. One end of rod 45 extends to and through an upper portion of end legs 22 which has a circular, calibrated scale 46 (FIG. 2) applied thereto. Rod 45 emerges through and defines the center of scale 46 and has an operating lever 47 attached thereto. By grasping and swinging the lever 47 in a rotary sense, shaft 45 may be rotated and such rotation is imparted simultaneously through mating gears 43-44 to jack screws 38-39. As will be evident, and as is conventional in such mechanisms, rotation of lower jack screw portions serves axially to extend or to retract upper jack screw portions which are bolted to end plates 33-34. Through the medium of operating lever 47, therefore, the assembly comprising end plates 33-34 and their supported shaft 27 may be raised and lowered in a vertical sense. The jack screws have a protected, guided accommodation in sub-housings 48 and 49 respectively mounted to and suspended from the frame rails 20-21. Operating lever 47 includes a pointer portion traversing calibrations on the scale 46. The arrangement facilitates the making of fine adjustments and readjustments in the vertical position of the shaft 27 relative to the frame bed as represented by frame rails 20-21.

The drum sander 28 positions between the end plates 33-34. It comprises an assembly including a hollow cylindrical shell 51 in a surrounding suitably fixed relation to shaft 27 at a location substantially centered between its ends. Longitudinally spaced apart centrally apertured interior walls 52 and 53 are welded to the cylinder interior and suitably fixed to shaft 27 for unison rotation. Overlaying the cylinder exterior and circumferentially thereof is a sheet of sandpaper 50. It should be understood that the sandpaper is detachably fastened to the cylinder in any convenient manner so that it may be replaced when worn or when it may be desired to replace a paper of one abrasive grade with one another.

The assembly comprising the sandpaper covered cylinder 51 and its supporting interior walls is accordingly rotatably driven by shaft 27. Moreover, it is raised and lowered with raising and lowering movements of the shaft. The sanding drum assembly is elevated relative to the frame bed and to a work support 60 bolted to the frame bed. Between the drum and support 60 there is defined a space 54 open from what may be termed the front and back of the machine. A workpiece resting on the support 60 and advanced through the space 54 may have surface contact with the rotating sanding drum to achieve surface finishing effects. Raising and lowering of shaft 27 increases and reduces the height or depth of space 54 and regulates the depth of cut taken in the workpiece by the rotating sanding drum.

Further comprised in the sanding drum assembly are power driven rolls for feeding the workpiece through the space 54, which rolls comprise an infeed roll 55 and an outfeed roll 56 (FIG. 7) each made up of a solid rod or shaft 57 covered by a softer rubber or rubber-like material 58. Shafts 57 extend between end plates 33 and 34 where they are accommodated in respective sets of vertically orienting slots 59 and 61. Adjacent to end plates 33 and 34 shafts 57 are journaled in respective bearing blocks 62 and 63. In each bearing block 62, 63 is a vertical throughbore 64. Passing freely through each throughbore 64 is a vertically orienting rod 65 the upper end of which is joined to a screw extension 66 based in an anchor abutment member 67. A compression spring 68 about each rod 65 is interposed and compressed between its bearing block and a nut 69 on its screw extension 66. As will be evident, feed rolls 55 and 56 are urged downward toward work support 60 and tend normally to assume a position in which roller shafts 57 limit against the bottoms of slots 59 and 61.

A workpiece, as for example the workpiece W shown in FIG. 7, when advanced into cooperative relation with the rolls 55 and 56, displaces the rolls upward in the slots 59 and 61, compressing springs 68 which pressure the workpiece downward upon support 60. The feed rolls and related parts are elements of the assembly comprising shaft 27 and end plates 33–34 and raise and lower with like movements of such assembly. The height of the assembly, relative to support surface 60, is selected (by adjustment of hand operated lever 47) to coincide with the desired finish thickness of the workpiece. As seen, for example in FIG. 7, the assembly is adjusted so that the perimeter of the sanding drum will relatively lightly engage the upper surface of workpiece W as it travels through space 54.

The feed rolls are, as noted, power driven, thus facilitating a smooth travel of the workpiece through the machine, at a constant rate of speed. Each core shaft 57 extends through and beyond end plate 33. At their ends they have respective gears 71 and 72 fixed thereto. A chain 73 interconnects the gears 71 and 72. Also on one shaft 57 is another gear 74 connected by a chain 75 to an output gear 76 driven by an electric motor 77. As will be obvious, the motor driven gear and chain mechanism produces a powered rotation of the feed rolls 55 and 56 when motor 77 is in operation. Frame mounted, spring urged arms 78 and 79 maintain tension in the chains 73 and 75.

A protective cover 81 (FIG. 1) cooperates with end plates 33–34 in enclosing the drum sander. It guards against injury from contact with the sander and confines generated dust. If desired, vacuum collecting means (partly shown at 82 in FIG. 1) may be mounted to communicate with the space 54.

Figure 6:
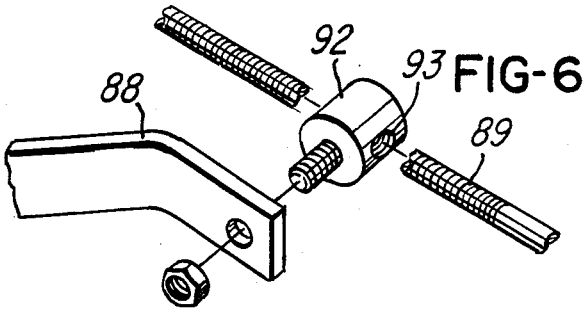
FIG. 6 is a detail view in perspective of mechanism comprised in the means to vary the speed of rotation of the main shaft.
Figure 4:
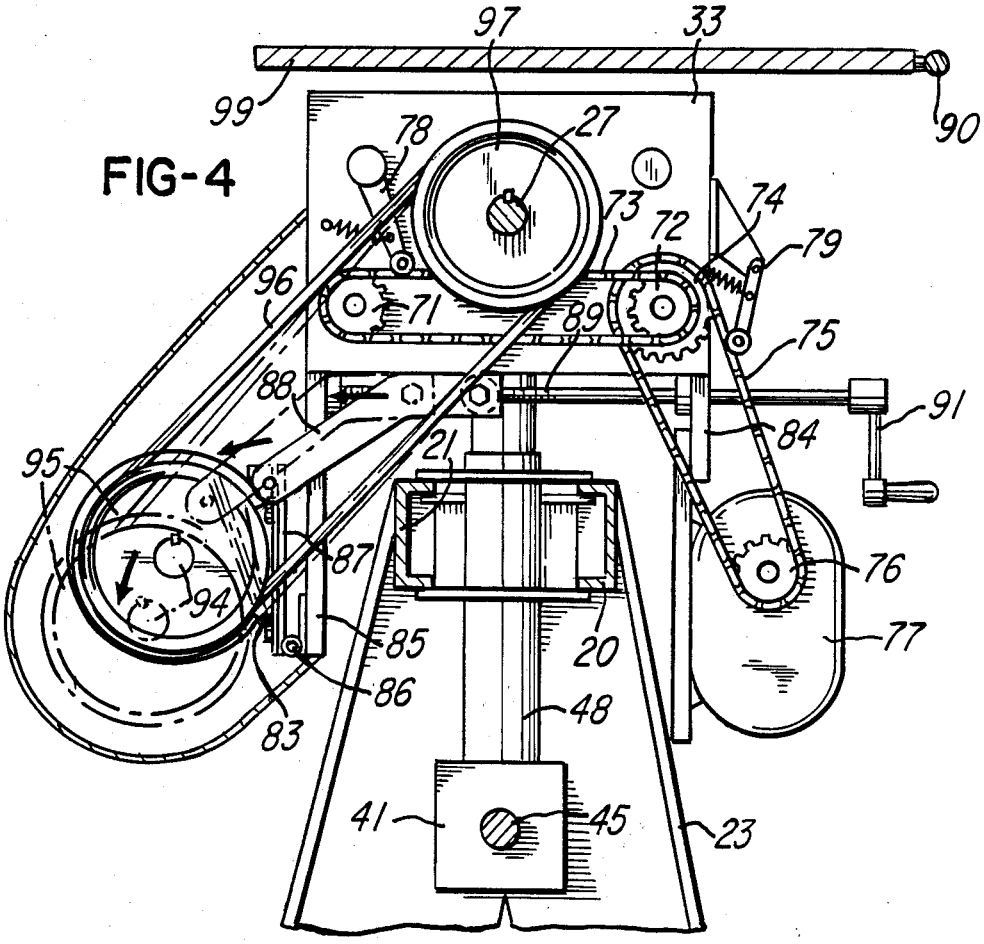
FIG. 4 is a view in cross section, taken substantially along the line 4—4 of FIG. 3.

The motor 77 powering the feed rolls of the drum sander mounts at what may be considered the front of the machine. Another electric motor mounts to the back of the machine and is responsible for the powered rotation of the main shaft 27. As a part of the assembly comprising interconnected end plates 33–34, there are provided at the front of the machine a dependent plate structure 84 and at the rear of the machine a dependent plate structure 85 (FIG. 4). The latter, through a hinge joint 86 is pivotally connected to a generally upright plate or motor mount 87. The motor, only the base 83 of which is seen in FIG. 4, is bolted or otherwise fixed to the plate 87. The assembly comprising the motor 83 and plate 87 are accordingly mounted for rocking motion relative to the plate structure 85. The hinged connection of the motor mount plate 87 to structure 85 is along its lower edge. At or near its upper end, plate 87 pivotally connects to one end of a link 88. At its other end link 88 connects to a transverse shaft 89 an outer end portion of which extends to and through front plate structure 84 and terminates in a crank arm 91. The opposite outer end portion of shaft 89 is expanded and abuts plate structure 85. The shaft 89 is externally threaded where it joins link 88 and is connected to the link by means of a knuckle nut 92 (FIG. 6) having a transverse internally threaded bore 93. The shaft 89 projects through and in the process thereof achieves a threaded connection with nut 92 which is fixedly connected to link 88 in the manner shown in FIG. 6 of the drawings.

Rotation of shaft 89, by turning of the crank 91, relatively advances and retracts the assembly comprising link 88 and knuckle nut 92. Such motion in turn is effective through link 88 and motor mount plate 87 to rock the motor 83 on hinge joint 86 to different positions relative to plate structure 85. The motor 83 rotatively drives a projected shaft 94 on which is mounted a split sheave pulley 95.

A belt 96 interconnects the split sheave pulley 95 to a pulley 97 mounted in connection with shaft 27. When motor 83 is in operation it is effective through the described belt and pulley arrangement to drive shaft 27. Rocking adjustment of the motor causes the belt 96 to move to different radial positions in pulley 95. Crank 91 accordingly becomes a speed control through which a constant speed of motor shaft 94 may be used to rotate main shaft 27 at substantially infinitely variable speeds of rotation. The structure of split sheave 95 with its opposed frusto-conical elements and the principle of the change speed operation herein referred to are thought to be sufficiently well known as not to require further explanation.

Figure 8:
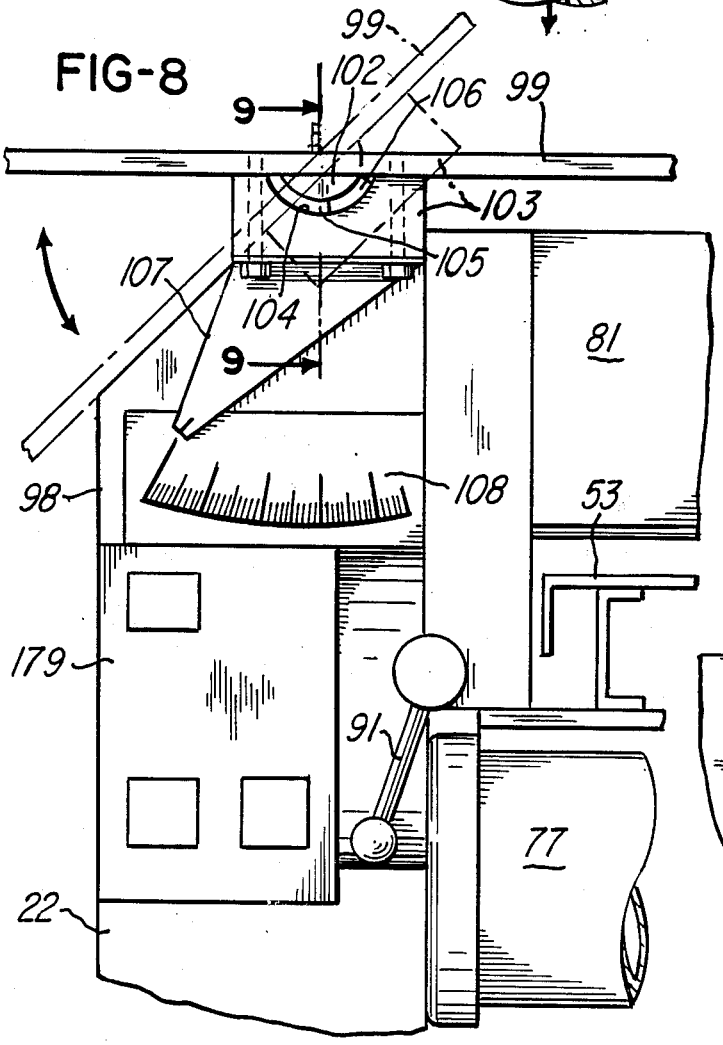
FIG. 8 is a detail view in front elevation, relatively enlarged with respect to FIG. 1, showing the saw table and related position indicating means.
Figure 9:
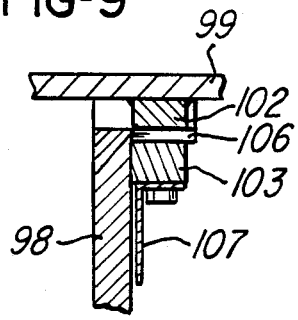
FIG. 9 is a detail view in cross section of the indicator means of FIG. 8, taken substantially along the line 9—9 of FIG. 8.

Rotary saw 29, seen more particularly in FIG. 3, is there shown as suitably fixed to one extremity of shaft 27, outwardly of drive pulley 97. It is housed in a frame structure 98 integrally connected with frame rails 20–21 and defining what may be termed a saw box. The upper end of this saw box is open so that a peripheral portion of the saw projects from the box. A work support table 99 overlying the saw box has therein a slot 101 accommodating the projection therethrough of a peripheral portion of saw 29. Slot 101 is sufficiently wide to allow for relative tilting movements of the table 99 so that cuts in a workpiece held to the table may be made set within a range of forty five degrees. As seen in FIG. 8, saw table 99 is conventionally pivotally mounted to frame structure 98, one or more half round protuberances 102 on the underside thereof, clear of saw 29, having a nested relation in a larger complementarily shaped semi-cylindrical recess 104 in a saddle member 103, to dispose in a radially spaced relation to the wall surface portion thereof which bounds this recess. Saddle 103 is bolted to table 99 in a surmounting embracing relation to the protuberances. Connected to the inner surface of the back wall of saw box 98 to project forwardly therefrom and perpendicular thereto is a tongue 106 which in transverse section is cupped in accordance with the shape of protuberances 102. Tongue 106 positions within and extends the length of recess 104 within the in the space 105 defined between the protuberances 103 and the bounding wall of this recess. It is the tongue 106 which provides a bearing surface for the protuberance 102 within the limits of its rotative adjustability (FIG. 8). The saw table is in this manner anchored to the machine frame, with the anchor connection affording the saw table freedom of arcuate adjustment about the location of protuberances 102.

Saddle member 103 adjusts arcuately with saw table 99 and has fastened to its undersurface a perpendicularly dependent pointer 107. The latter is adapted to traverse a frame mounted scale 108 calibrated to indicate angular positions of adjustment of the saw table. To hold the table in selected positions of adjustment a telescoping rod and cylinder mechanism 109 is connected between a lug 111 on the table and a lug 112 on the frame. An applied screw 113 functions in an obvious manner to selectively hold the table in a selected position of adjustment and release the table for tilting motion as and when required.

In accordance with a known saw table practice, the table 99 is overlaid by a "fence" assembly 80. Functioning as a saw guard and as a guide and aligner for a workpiece, the "fence" 80 is slidable laterally on the table by reason of being mounted on a frame rod 90. Locking means, including a lever 100, is operable to hold the "fence" in set positions of adjustment.

As indicated, the rotary saw 29 is mounted on the shaft 27 while the saw table 99 is attached to the machine frame. Accordingly, incremental vertical movements of the shaft 27 used to vary the height of the drum sander may also be used to vary the extent to which saw 29 projects above table 99 and thereby to control the depth of cut made in a workpiece held to the table.

Figure 10:
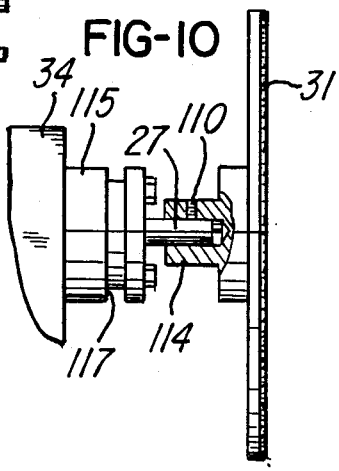
FIG. 10 is a detail view showing a sanding disc mounted to the main drive shaft.

That end of the shaft 27 opposite the end mounting saw blade 29 is in a freely projecting relation to end plate 34. On it, a working tool may be mounted, for example the disc sander 31, or, in another example, a spur center 30. As seen in FIGS. 1 and 10, the disc sander has a hub portion 114 adapted to fit over the freely projecting shaft end. A set screw or like means 110 detachably secures the hub 114 to the shaft and thereby adapts the disc sander for rotation by and with the shaft. The disc sander is representative of a variety of shaping, finishing, cutting and like work performing tools available for mounting on the main shaft 27. The spur center 30, with end flutes 40, is one such tool. It is adapted, along with centering device 28 on the tail stock 24, to hold a workpiece for turning or such other procedures as may be performed on a lathe.

Figure 14:
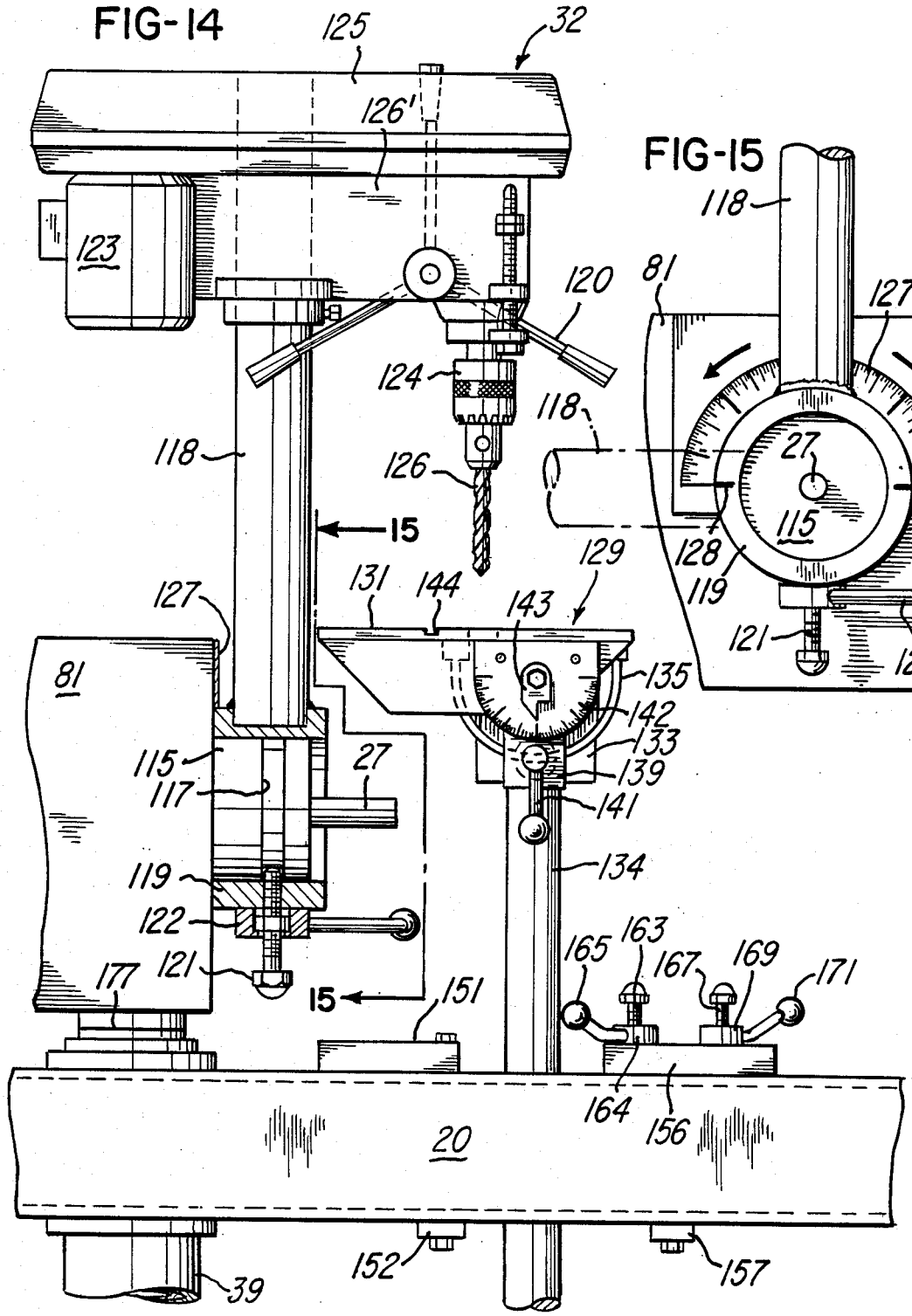
FIG. 14 is a detail view in side elevation showing the drill press and work holding table, parts being broken away to show press mounting means.
Figure 15:
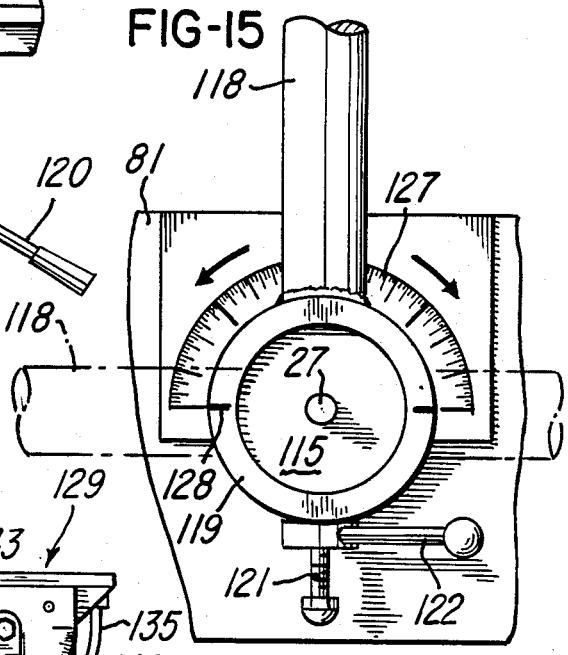
FIG. 15 is a detail view in front elevation taken substantially along line 15—15 of FIG. 14.

As shown in FIGS. 1, 14 and 15, a drill press 32 utilizes the shaft 27 as a locating or reference point on the machine. The drill press assembly comprises a cylindrical tubular hub member 115 which is bolted to the outwardly facing side of end frame 34 to project therefrom, perpendicular thereto, in a concentric closely spaced relation to shaft 27. A peripheral groove 117 extends around the circumference of the mounting member.

The drill press 32 is itself a known commercially available device. It mounts on and for rotation relative to the upper end of a post 118. At its lower end post 118 is welded or otherwise secured to a collar 119 adapted for a slip fit to and over hub 115. Collar 119 is releasably fixed to hub 115 by a radially applied set screw 121 which projects therethrough to anchor at its innermost end within and to the base of groove 117. As projected into the groove 117, screw 121 holds collar 119 from removal from an installed position and acts also to hold the collar in a selected rotary position of adjustment relative to hub 115. A lock nut 122, having an attached handle, is threadedly engaged about an outwardly projected portion of screw 121 to lock this screw in a set position.

The drill press is a self contained unit in which a motor 123 rotatably drives a chuck 124 through conventional transmission means housed in cases 125 and 126. In this instance a drill 126 one end of which is held in chuck 124 depends therefrom coaxially therewith. As is obvious, a variety of other tools may be selectively installed in place of the drill 126 as and when needs require. The drill press is movable in plural senses adapting it to use in varying attitudes and working situations depending upon work requirements. For example, the drill press is rotatable about the post 118 so that it can drill at locations offset from the axis of shaft 27. It can also be swung out of the way when non-drilling machine operations are to be performed, in addition to which it can be raised or lowered to different heights by raising or lowering shaft 27, as before described. Further, by loosening lock nut 122 and backing off set screw 121 the drill press including post 118 can be rocked arcuately about hub 115. Within a wide range of angular movement the press can be reestablished and locked in a selected position radially of shaft 27. Still further, and forming a conventional part of the drill press, a three-armed lever 120 (FIG. 14) provides for advancing and retracting movements of the drill relative to the work. On the front of the end plate 34 is an arcuate scale plate 127, which together with markings 128 on the collar 119 provide for accurate positioning and repositioning of the drill press in an arcuate sense.

Intermediately of headstock and tail stock portions of the machine is a combined work rest and tool rest assembly 129 (FIGS. 1, 3, 11 and 12). As suggested by its given name, assembly 129 supports workpieces held to the tool which is mounted on or positioned adjacent to the adjacent end of shaft 27 at any given time. Assembly 129 also provides a rest for tools, for example a tool bit which must be held to a workpiece mounted between the shaft 27 and a centering nose member 25 on the tail stock 24, which together make up a lathe structure.

The assembly 129 has a flexibility of adjustment making a support table 131 thereof substantially universal in the attitudes of use it may assume. The sides of table 131 have downturned flanges (FIG. 12) between which transversely extends a shaft 132 which mounts thereon in bearing relation thereto. Intermediate its ends shaft 132 extends through and is supported by and for rotation in a bearing block 133 which is mounted on and defines the upper end of a support post 134. An arcuately curved rod 135, attached at its ends to the underside of table 131 and positioned in a parallel laterally centered relation to the sides of said table, depends therefrom to have a lowermost portion thereof (FIG. 12) pass through an aperture 137 formed in, transversely of and intermediate the ends of the axial length of a stud 136 anchored in and projected from and perpendicular to one face of bearing block 133, with clearance therebetween. As shown in FIG. 13, aperture 137 is curved, in conformance with the curvature of rod 135. A screw member 138 projected through and in bearing relation to a plate 139, dependent from and perpendicular to shaft 132 which projects therethrough, has a laterally projected operating handle connected to its outermost end and its opposite end portion threadedly engaged in a tapped bore in stud 136 which intersects aperture 137 at the midpoint of its curve. As will be obvious, screw 138 is a set screw which may be rotated in stud 136 to move it to and from a clamping relation to rod 135.

Figure 11:
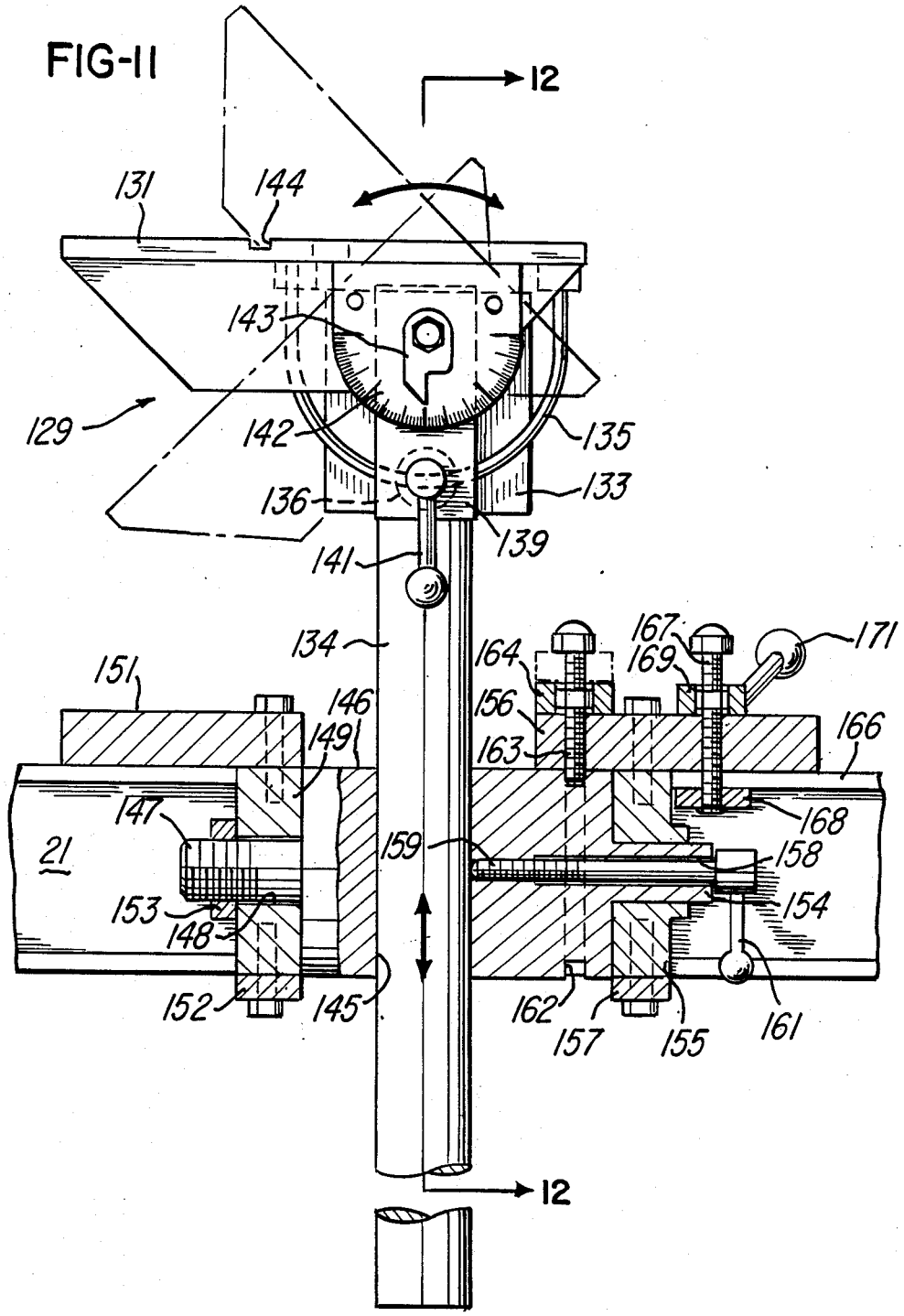
FIG. 11 is a detail view of a combination work rest and tool support, with the mounting means therefor being shown in cross section.

Fastened to one downturned flange on table 131 is a scale plate 142 surrounding a projecting end of shaft 132. A pointer 143 fixed to shaft 132 is appropriately disposed with reference to suitable indicia on plate 142. As will be evident, and as indicated in FIG. 11, table 131 is tiltable on and with reference to bearing block 133 and post 134, in opposite directions, from a horizontal position in which it is generally parallel to the frame bed. As will be obvious, screw 138 is backed out of contact with arcuate rod 139 to permit tilting movements of table 131 and turned into contact with this rod to fix the table in a selected attitude of use. In the tilting of the table, scale plate 142 moves therewith and relative to pointer 143 thereby to indicate the degree of its tilt and facilitate an accurate positioning and repositioning of the table. A groove 144 in the upper surface of table 131 facilitates the mount thereto of a gauge or such other device as may be used to set a workpiece for the proper working thereof by one or more adjacent tools associated with the adjacent end portion of the shaft 27 or a tool in the attitude thereof required for its proper function, for example on a workpiece held in the available lathe which forms part of the machine and is operated by way of shaft 27.

Table support post 134 extends downward into the frame bed between its rail portions 20 and 21 to pass through a vertical diametral aperture 145 in a cylindrical member 146 positioned between the rails the central axis of which member 146 has a horizontal orientation (FIG. 11). In connection with and projecting from the center of the left end face of member 146 is a perpendicularly related threaded stud 147 projected through a central complementary opening 148 in a non-rotatable block shaped plate 149 one face of which is in flush abutment with said left end face of member 146.

Block 149 is laterally confined between and by rails 20 and 21 and held in its required position by being bolted to bars 151 and 152, which respectively bridge the upper and lower surface portions of said rails and have their respective end portions respectively seat in bearing relation thereto. The bolts by which said bars 151 and 152 are attached to block 149 are located between and in spaced relation to said rails. Nut 153 applied to the outwardly projected end portion of stud 147 holds the member 146 and block 149 in an assembled relation.

Formed integral with and projecting from the center of the opposite end face of member 146 is an axially extended small diameter cylindrical projection 154 having a central axial bore 158 the innermost end of which radially intersects aperture 145, in which post 134 bears for rotation relative to member 146. The innermost end portion of this bore is tapped while its outermost end portion is slightly expanded by a counterbore to have passed therethrough the body of a bolt 159 the projected end portion of which threadedly engages in the tapped portion of this bore. As will be obvious, an axial adjustment of bolt 159 is all that is required to selectively set it in clamping relation to post 134 to preclude its rotation or to withdraw it therefrom to free the post for rotation when required. A lock nut at the outwardly projected head end of bolt 159 is provided with a laterally projected handle to facilitate its operation. Projection 154 extends through a central aperture in a block-shaped plate 155 which is similar to block 149 and similarly laterally confined by and between rails 20 and 21 and set in its required position by being bolted to cross bars 156 and 157 which respectively bridge the upper and lower surface portions of said rails and have their respective end portions respectively seat on and in bearing relation thereto. The bolts by which said bars 156 and 157 are attached to block 155 are located between and in spaced relation to the rails. As so set, one face of block 155 is in flush abutment to the adjacent end face of member 146.

Cylindrical member 146 has a circumferential groove 162 in its outer surface located in a closely spaced adjacent relation to that end surface thereof which abuts block 155. A portion of cross-bar 156 which extends over an upper surface portion of member 146 has a set screw 163 installed in a tapped throughbore thereof to position radial to and in line with groove 162 to which it opens. On a suitable adjustment thereof the innermost end portion of screw 163 is lodged in and in clamping relation to the base of groove 162 to effectively prevent rotation of member 146, when required. A lock nut 164 having a laterally projected operating lever 165 may be selectively adjusted to hold the screw 163 in that position in which it is set.

On release or backing off of nut 153 and set screw 163 the projecting studs 147 and 154 function as parts of member 146 and the latter is then free for the bearing rotation thereof in and relative to blocks 149 and 155. Thus, at such point cylindrical member 146 may be freely adjusted about its central longitudinally extending axis to lend a further element of versatility to table 131 as to the selection of a particular orientation thereof suited for a particular mode of its use. As will be seen, when bolt 159 is retracted, post 134 is free to move in both vertical and rotary directions.

Frame rails 20 and 21 are formed with inturned flanges, as for example an upper flange 166 on the rail 21 (FIG. 11) duplicated by a similar flange on rail 20. Another set screw 167 applied to and through another portion of cross bar 156, between the rails 20 and 21 and adjacent to the latter, has the lower end portion thereof projected through an aperture in a plate 168 (FIG. 11) which bridges said inturned flanges 166 and has the end portions thereof in respectively underlying bearing relation thereto. Applied to the lowermost projected end portion of screw 167, in underlying relation to plate 168, is a threadedly engaged nut in supporting relation to that end of plate 168 seen in FIG. 11. The opposite end portion of plate 168 is similarly supported. On appropriate adjustment of the respective set screws 167 and their applied nuts the respective ends of plate 168 may be easily moved to and from a clamped engagement with the undersurface portions of plate 168. Locking means 169, 171 applied to set screws 167 are similar to locking means 164, 165 and similarly serve to hold screws 167 in their selectively set positions of adjustment.

By means of the foregoing arrangement table 131 of the work and tool rest assembly 129 may thus be caused to assume a variety of positions and attitudes relative to the machine frame and various operating components of the machine which are associated therewith. By virtue of its bearing mount on shaft 132, table 131 is tiltable in each of opposite directions, from a horizontal attitude thereof, to incline to and from the adjacent end of shaft 27. Further, by reason of the bearing mount of post 134 in member 146 and a selective adjustment of set screw 159, table 131 can be readily raised and lowered and locked at a selected level of elevation. Table 131 can also be rotated since the post 134 is rotatably received in member 146. As long as post 134 is locked to cylindrical member 146 and nut 153 and set screw 163 are backed off from their locking positions, member 146 may be bodily turned and table 131 freely rotated to any position of adjustment within a plane perpendicular to the central axis of member 146. When the nuts applied to the lowermost projected end portions of set screws 167 are in a release position the entire tool and work rest assembly 129 can be moved freely along the length of rails 20, 21, within the obviously available limits thereof, to any desired position of longitudinal adjustment. In this last respect, this slidability feature of the assembly 129 makes it particularly useful in a turning operation wherein a workpiece is mounted between shaft 27 and nose member 25 to have its periphery selectively reduced and formed by application thereto of a tool bit. With table 131 set at a proper angle and a tool bit held or clamped thereto, tool rest assembly 129 may be selectively slid along rails 20, 21 and selectively adjusted as to its position, if and when needs require, to achieve a continuous working of a mounted and rotating workpiece along the length thereof.

The tail stock 24 of the lathe installation embodied in the illustrated machine is itself variably positionable along the rails 20, 21 in order that workpieces of differing length may be accommodated between a spur center 30 on shaft 27 and the nose piece 25 of tail stock 24. Tail stock 24 includes a lower plate portion 172 seating to and supported by the rails 20, 21. A screw member 173 extending through, perpendicular to and in a dependent relation to plate portion 172 depends downwardly therefrom between rails 20, 21 to have its lowermost end portion engaged in and to a perpendicularly related plate 174. The plate 174 is positioned below and in a transverse bridging relation to the rails and, at its ends, underlying relation the rail flanges at the bottom thereof. Applied to and in threaded engagement with that end portion of screw 173 above plate 172 is a cap nut 175. An arm 176 is attached to the nut 175 for ease of turning. A manipulation of arm 176, releasing plate 174 from frictional engagement with rail flanges 177 allows the tail stock 24 to be readjusted in a longitudinal sense, along the frame bed. At a location correct for the length of workpiece to be turned, arm 176 is rotated in an opposite sense to draw plate 174 into frictional locking engagement with the undersurfaces of the rail flanges.

The raising and lowering of shaft 27 to a position of alignment with tail stock member 25 is facilitated by use of a reference mark 177 on the jack screw 39. When this mark coincides with the upper end of screw housing 49 the shaft 27 and tail stock member 25 are aligned.

A scale plate 178 on the jack screw 39 is useful in an initial positioning of the drum sander 28. A vertical series of calibrations on the scale 178 is effectively traversed by a pointer 179 extending laterally from work support 60 of the drum sander. Using the scale 178, an approximately set position of the drum sander may be arrived at, with fine adjustments being made by referring to the scale 46 (FIG. 2).

In a conventional use of the machine as a lathe, the shaft 27 is vertically adjusted until a spur center 30 thereon aligns with tail stock nose piece 25, the reference mark 177 being advantageously used in this procedure. In another use of the machine as a lathe, a spur center 30 is not mounted to the shaft 27 but instead a suitably configured mounting plate is attached to the shaft to rotate with it. A workpiece to be shaped is bolted or screwed to the plate and thus rotates with the shaft. A tool bit held to the workpiece accomplishes the desired shaping thereof. A wood turning operation of this kind accomplished without use of the tail stock, serves a particular purpose when the work piece is wide bodied or broad in its lateral dimension. The present machine readily accommodates such a mode of use since the shaft 27 can be raised to suit the dimension of the workpiece or of the mounting plate fixed to the shaft. A gap or reces in the machine bed, as is commonly used in lathes, is unnecessary in the machine of the present invention.

The several machine controls are arranged to be conveniently accessible for easy operation. They include a switch box 181 mounted to legs 22 containing switches for starting and stopping the operation of motors 77 and 83.

A woodworking machine according to the invention offers obvious advantages of simplicity, convenience and versatililty, particularly as embodied in a machine for home workshop and like use. It has a sturdy durable construction, one which provides evident economies of manufacture. All operating functions are instantly available for use and presented in a readily accessible side by side form. The substantially universal adaptability and multi-faceted application of what in essence is a complete machine work shop that is represented by embodiments of the present invention is reflected by the fact one or more persons can use the same embodiment to selectively and in any desired sequence, perform, by way of illustration but not by way of limitation, sawing, various types and degrees of sanding and finishing, drilling, boring, turning, a variety of cutting and multiple lathe type operations.

A feature of the invention lies in use of a single main shaft as the operating means for achieving numerous end products within a very limited amount of space and at a minimal capital cost and with maximum efficiency. In carrying out the work concept, a compact simplified structure is provided in which opposite ends of the shaft power different machine components while intermediate portions are in a driving relation to other machine components. The arrangement lends itself especially to the illustrated combination in which a drum sender surrounds the main drive shaft, to be supported on and driven thereby, while a rotary saw and other working tools mount to and adjacent oppositely projecting ends. In a further common relationship of parts the main shaft is structured for vertical incremental adjustment, with such adjustment being reflected in each of a plurality of machine operations. A single operating control, as in the form of exteriorly accessible lever 47, is effective to change the position of the rotary saw, the height of the drum sander and the vertical position of the headstock of the lathe structure. A drill press is positioned for convenient use and for a support about the main shaft. A combined work and tool rest assembly is adjustable in a multiplicity of senses, with simple and secure mechanisms being provided to aid in adjustments made.

In the embodiment of FIGS. 1–15 the drill press 32 is a self contained unit which is mounted about the shaft 27, effectively using the shaft as a locating and positioning means. Within the concept of multiple mechanisms operated by a common shaft, the invention also has in view a drill press operation in which the main drive shaft of the machine serves not ony as a reference point for the press but as a drive means therefor as well.

Figures 16, 17, 18:
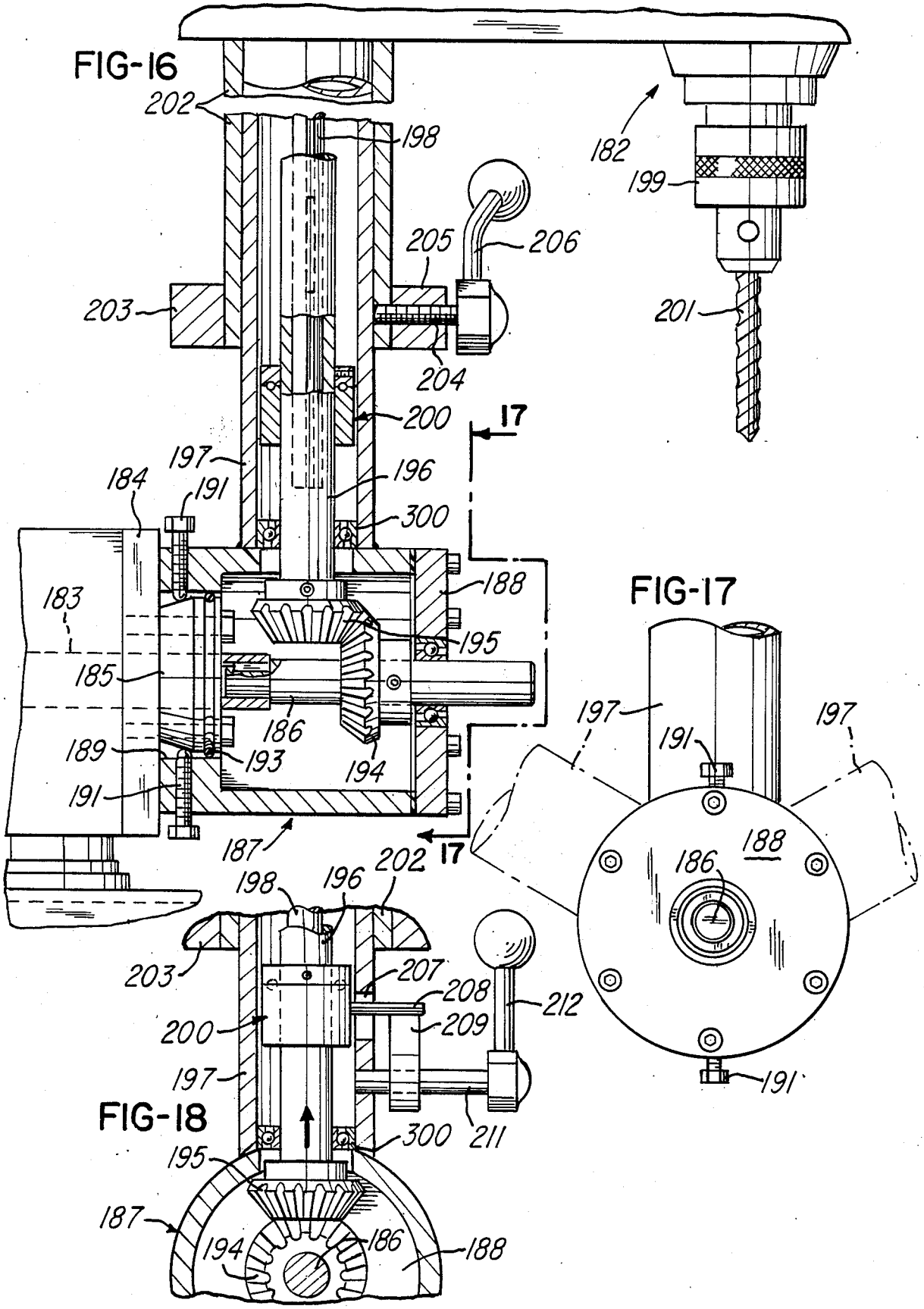
FIG. 16 is a fragmentary view in longitudinal section, showing a preferred modified form of the invention invention embodiment of FIGS. 1-15 in which the drill press is rotatably driven from the main shaft.
FIG. 17 is a view taken on line 17—17 of FIG. 16.
FIG. 18 is a detail sectional view illustrating a disabling mechanism associated with the structure of FIG. 16.

FIGS. 16–18 illustrate a preferred embodiment of the invention which constitutes a modification of that embodiment shown in FIGS. 1–15 featuring a substitution for the press 32 of a drill press 182. The illustrated structural features of the embodiment of FIGS. 1–15 otherwise remain the same except for the mode of connection of the drill press 182 directly to the main drive shaft which corresponds to the shaft 27 but here illustrated, for convenience of disclosure, by the number 183. In this instance shaft 183 projects through an opening in and in bearing relation to a perpendicularly related end plate 184 corresponding to the end plate 34 of the first described embodiment of the invention. Bolted to and projected perpendicularly from the central portion of the outer face of end plate 184 is a hub member 185, through and beyond which shaft 183 projects for a short distance at which point it is extended by a relatively short shaft 186 which is in a coaxially interconnected keyed relation thereto. A cylindrically-shaped hollow gear housing 187 having one end thereof abutted to and suitably secured in connection with end plate 184 projects outwardly therefrom and perpendicular thereto to have its cylindrically shaped, longitudinally extending wall portion position about and in concentrically spaced relation to the projected extremity of shaft 183 and a portion of the length of shaft 186 which forms a coaxial extension thereof. The end abutted wall portion of housing 187 has defined therein a smooth walled bore 189 the bounding surface portion of which, in an installed position of the housing surrounds hub member 185. Shaft extension 186 projects through and is supported by a bearing in the center of the end wall of housing 187 which is remote from the plate 184. That end portion of shaft extension 186 which projects through and beyond the housing 187 is appropriately adapted for the mounting thereto, selectively, any one of a number of tools which may be used in the production on the machine of a multitude of end products to be formed of wood, plastic or like materials. As stated previously, gear housing 187 has a smooth walled bore 189 which in an installed position of the housing surrounds hub member 185. A plurality of set screws 191 is carried by the gear housing in a closely adjacent spaced relation to that end surface thereof which abuts end plate 184. These set screws are radially oriented with reference to the peripheral wall of the gear housing and so arranged to be turned into and out of engagement with the periphery of the hub member. Such periphery presents a tapered surface 192 sloping downward toward end plate 184. As will be evident, with the gear housing held to plate 184, if set screws 191 are turned inward upon hub 185 the housing will be effectively fixed to hub 185 and at the same time drawn forcibly to a seat on plate 184. The periphery of hub member 185 also includes a circumferential groove nesting in part an O-ring 193 a portion of which projects outwardly thereof and radial thereto. O-ring 193 is compressed against the wall of bore 189 and cooperates with closure plate 188 in retaining lubricant in the gear housing.

Within the gear housing a spur gear 194 is mounted to and in connection with shaft extension 186 to rotate therewith. A like gear 195 within the gear housing, in mesh with gear 194, is fixed to and for rotation with shaft 196 which extends outwardly from said housing, radially thereof and radially of shaft 183 and its extension 186. The portion of shaft 196 outwardly of and radial to housing 197 extends vertically of the housing is received within and in concentrically spaced relation thereto a hollow cylindrical post 197. Mounted about and in slidable relation to shaft 196 is a tubular bearing structure 200 the outer peripheral surface of which is immediately of the inner wall surface of post 197 the base of which is integrally connected to the outer peripheral surface of housing 187, about the opening from said housing through which the tubular shaft 196 projects. A bearing 300 is positioned between the inner surface of post 197, adjacent the base thereof and in surrounding bearing relation to the shaft 196. Extending upwardly in post 197, tubular shaft 196 is in a telescopic sliding relation to an activator shaft 198 a portion of the length of which projects therein by way of an open outer end of shaft 196. Activator shaft 198 and tubular shaft 196 are keyed together for unison rotation. Activator shaft 198 extends upwardly and outwardly from tubular shaft 196 into the drill press proper, and, as will be understood, is there drivingly related to a transmission mechanism leading to a drill chuck 199 and drill element 201. According to the construction and arrangement of parts, rotary motion of the main shaft 183 is transmitted directly through shaft extension 186, gears 194 and 195, the telescoping, keyed shafts 196 and 198 to apply in driving relation to the transmission provided in the drill press proper, producing as a result therefrom a powered drive of drill chuck 199 and correspondingly the tool which is chucked thereto.

A tubular sleeve 202 fixed at its upper end to the body of the drill press proper is telescopically mounted to and about the upper end portion of post 197 in a sliding relation thereto. The drill press and its sleeve-like projection 202 are thus mounted to post 197 for freedom of relative vertical and rotary motion with reference thereto. Sleeve 202 carries on its exterior a locking ring 203 including a set screw 204 movable radially through the sleeve wall into and out of contact with the post 197. Screw 204 rotates in a nut 205 and has an attached handle 206 which facilitates the turning thereof. As will be evident, the locking ring 203 allows the tubular sleeve 202 to be variably adjusted in longitudinal and rotary senses relative to post 197 and to be locked in set positions of adjustment. As noted previously post 197 and its contained tubular shaft 196 occupy a position radial to the axis of shaft 183. If set screws 191 are loosened, the entire assembly comprising the gear housing 187 and connected drill press can be rotated about the hub member 185 to a selected position of different angularity relative to the main shaft. Retightening the set screws fixes the assembly in its new position of adjustment.

It may be desirable, in some instances, to disengage the drive to the drill press while the machine is being used in another operation. With this in view, and as shown in FIG. 17, the hollow part 197 has a short length vertical slot 207. A pin 208 extends from outside the post through the slot 207 into the post interior where an inner end thereof is fixed to the bearing structure 200. Underlying an outer projecting portion of pin 208 is a cam 209. The latter is made fast to a stub shaft 211 mounted in the wall of post 197 to project radially therefrom and to have freedom of relative rotary motion. A lever arm 212 is attached to stub shaft 211 for ease of turning. The cam 209 includes on its peripheral surface a high point or rise which when out of cooperative relation with pin 208 allows structure 200 and attached tubular shaft 196 to occupy a lowermost position (FIG. 16) wherein gear 195 meshes with gear 194. However, if cam 209 is turned to bring its high point into cooperative relation with pin 208 the result is to vertically lift the assembly comprising structure 200 and tubular shaft 196, raising gear 195 out of meshing engagement with gear 194 (FIG. 17). In this position of the parts, therefore, rotation of main shaft 183 is without effect on drill chuck 199.

From the above description it will be apparent that there is thus provided a device of the character described possessing the particular features of advantage before enumerated as desirable, which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A woodworking or like machine, including a frame structure supporting apparatus for performing multiple machine functions, said apparatus including sawing, sanding and lathe machine components, said apparatus further including a main shaft constituting a principal moving part of the machine and commonly mounting and driving said machine components, said machine components being arranged in a side by side relation on said frame structure with said sawing and lathe components being in a flanking relation to said sanding component, said sanding component being a drum sander in a surrounding driven relation to an intermediate portion of said shaft, opposite end portions of said shaft projecting from the ends of said drum sander and engagingly driving at one end said sawing component and at the other end said lathe component and said machine components further including a drill press mounted radially of a projecting end portion of said shaft and adjustable to different radial positions with respect to said shaft.

2. A woodworking or like machine, including a frame structure supporting apparatus for performing multiple machine functions, said apparatus including sawing, sanding and lathe machine components, said apparatus further including a main shaft constituting a principal moving part of the machine and commonly mounting and driving said machine components, said machine components being arranged in a side by side relation on said frame structure with said sawing and lathe components being in a flanking relation to said sanding component, said sanding component being a drum sander in a surrounding driven relation to an intermediate portion of said shaft, opposite end portions of said shaft projecting from the ends of said drum sander and engagingly driving at one end said sawing component and at the other end said lathe component, the said other projecting end portion of said shaft being presented at its extremity as a rotating lathe headstock portion and serving alternatively as a mount for a sanding disc or like working tool.

3. A machine as in claim 2, said machine components further including a drill press mounted radially of said other projcting end portion of said shaft intermediately of said drum sander and said shaft extremity and adjustable to different radial positions with respect to said shaft.

4. A machine according as in claim 3, the frame supported apparatus including a combined work and tool rest positioning and functioning to be a part of machine operations deriving from said other projecting end portion of said shaft.

5. A machine as in claim 4, said combined work and tool rest being mounted for longitudinal sliding adjustment on said frame structure and incorporating in itself a capability of rocking adjustment in senses perpendicular to one another.

6. A woodworking or like machine, including a frame structure supporting apparatus for performing multiple machine functions, said apparatus including sawing, sanding and lathe machine components, said apparatus further including a main shaft constituting a principal moving part of the machine and commonly mounting and driving said machine components and means for bodily raising and lowering said main shaft, such raising and lowering movements being reflected in simultaneous control adjustments in at least certain of said machine components.

7. A woodworking or like machine, including a frame structure supporting apparatus for performing multiple machine operations, a rotated main shaft in said frame operatively connected to transmit its rotation to machine components involved in the performing of said multiple machine opertions, means for rotating said shaft, and means for incrementally raising and lowering said shaft for simultaneous incremental change in the working position of at least certain of said machine components.

8. A machine as in claim 7, and means for effecting a substantially infinite number of variations in the speed of rotation of said shaft.

9. A machine as in claim 7, wherein said shaft is part of an assembly further including spaced apart end plates mounting said shaft for relative rotary motion, end portions of said shaft projecting through and beyond said end plates, a machine component between said end plates and rotatably driven by said shaft, and other machine components operatively driven from said opposite end portions of said shaft, said means for raising and lowering said shaft acting thereon through said assembly.

10. A machine as in claim 9, wherein said means for rotating said shaft is a part of said assembly.

11. A machine as in claim 9, characterized by means accessible from the machine exterior for operating and controlling said raising and lowering means.

12. A machine as in claim 9, said machine component between said end plates being a drum sander mounted on said shaft for rotation therewith, the frame structure providing a workpiece support beneath said drum sander and the raising and lowering of said shaft serving incrementally to advance and retract said drum sander toward and from said support.

13. A machine as in claim 9, one of said other machine components being a rotary saw mounted on and rotatably driven by one projecting end portion of said shaft, and a work support table mounted on said frame structure and configured to allow a peripheral portion of said saw to project above it, the raising and lowering of said shaft serving to vary the extent to which said saw projects above said table.

14. A machine as in claim 13, said table being tiltably adjustable relative to the frame structure and to said rotary saw, characterized by means for holding said table in tilted positions of adjustment.

15. A machine as in claim 13, another one of said machine components being a lathe, the projecting end portion of said shaft opposite said one projecting end portion being utilized as a headstock means in said lathe, said frame structure mounting an oppositely facing tail stock means, the raising and lowering of said shaft providing for a centering of the headstock means relative to said tailstock means and for a vertical adjustment of the headstock means relative to frame structure.

16. A woodworking or like machine including a frame structure providing a fixed support for a workpiece advanced through the machine for surface sanding, a shaft rotatable in said frame structure, a drum sander mounted on said shaft in an overlying relation to said fixed support and rotatively driven by said shaft, a workpiece being adapted to pass through the machine between said fixed support and said drum sander, and means for raising and lowering said shaft relative to said fixed support to vary the depth of cut taken in the surface of a workpiece by said sander.

17. A machine as in claim 16, said shaft being part of an assembly further comprising end plates providing spaced apart bearings in which said shaft rotates, said drum sander positioning between said end plates, and opposite end portions of said shaft projecting through and beyond respective end plates for utilization in other work performing operations whereby drum sanding may be carried out at a central location and other machine operations carried out to either side of the drum sanding operation with each being constantly available for use.

18. A woodworking or like machine as in claim 1, said apparatus further including a drilling machine component rotatively driven in response to rotation of said main shaft.

19. A woodworking or like machine as in claim 18, and means selectively to enable and to disable the driving relation between said main shaft and said drilling machine component.

20. A woodworking or like machine, including a frame structure supporting apparatus for performing multiple machine operations, a rotated main shaft in said frame operatively connected to transmit its rotation to machine components involved in the performing of said multiple machine operations, at least one end of said shaft freely projecting for use in performing selected machine operations, a frame mounted hub member through which said one end of said shaft extends, a drilling component mounted to said hub member for relative rotary motion, said drilling component mounting to said hub member substantially radially of said shaft, and means for securing said drilling component in selected positions of angularity relative to said shaft.

21. A machine as in claim 20, and means utulizing the rotary motion of said shaft to power said drilling component.

22. A machine as in claim 21, both ends of said shaft freely projecting for use in performing machine operations, all said machine operations being powered by the rotation of said main shaft.

23. A machine as in claim 20, said shaft being part of an assembly supported in said frame structure relative raising and lowering motions, said hub member being a part of said assembly, and said machine components other than said drilling component mounting on said shaft, and means for raising and lowering said assembly to position and reposition said machine components relative to the frame structure all at the same time.

24. A machine as in claim 23, including a pair of scale devices for indicating the vertical position of said assembly, one being calibrated for a rough approximation of a desired setting and the other being calibrated for fine adjustments in the setting, and a single means for accomplishing the raising and lowering of said assembly.

25. A woodworking machine as in claim 23, wherein a tail stock means is supported by said frame structure in opposing relation to said one extending end of said shaft, one of the multiple operations of which the machine is capable being a turning operation in which a workpiece is supported between said one extending shaft end and said tail stock means, and said assembly being settable to a high level in which said shaft is out of alignment with the tail stock means facilitating a turning operation in which said tail stock means is not used.

* * * * *

UNITED STATES PATENT AND TRADEMARK OFFICE

CERTIFICATE OF CORRECTION

PATENT NO. : 4,830,069

DATED : May 16, 1989

INVENTOR(S) : Emmert Milyard

It is certified that error appears in the above-identified patent and that said Letters Patent is hereby corrected as shown below:

Col. 1, line 9, the illegible aspect of "reliably" is corrected.

Col. 8, line 29, "126" is corrected to read -- 126' --. (1st occurrence)

Col. 12, line 33, "reces" is corrected to read -- recess --.

UNITED STATES PATENT AND TRADEMARK OFFICE

CERTIFICATE OF CORRECTION

PATENT NO. : 4,830,069

DATED : May 16, 1989

INVENTOR(S) : Emmert Milyard

It is certified that error appears in the above-identified patent and that said Letters Patent is hereby corrected as shown below:

Col. 3, line 56, "invention" is deleted.

Col. 5, line 8, second occurrence of word "one" is deleted.

Col. 7, line 20, "in" is deleted;

line 21, "the" (first occurrence) is deleted.

Col. 16, line 23 (Claim 3, line 3), "projcting" is corrected to read -- projecting --;

line 27, (Claim 4, line 1), "according" is deleted;

line 53, (Claim 7, line 6), "opertions" is corrected to read -- operations --.

Col. 18, line 25 (Claim 21, line 1), "utulizing" is corrected to read -- utilizing --.

Signed and Sealed this

Sixth Day of February, 1990

*Attest:*

JEFFREY M. SAMUELS

*Attesting Officer* *Acting Commissioner of Patents and Trademarks*